US008205459B2

(12) United States Patent
Garner et al.

(10) Patent No.: US 8,205,459 B2
(45) Date of Patent: Jun. 26, 2012

(54) THERMO-ELECTRO-ACOUSTIC REFRIGERATOR AND METHOD OF USING SAME

(75) Inventors: Sean Garner, Burlingame, CA (US); David Eric Schwartz, Menlo Park, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 451 days.

(21) Appl. No.: 12/533,874

(22) Filed: Jul. 31, 2009

(65) Prior Publication Data

US 2011/0023500 A1 Feb. 3, 2011

(51) Int. Cl.
*F25B 9/00* (2006.01)

(52) U.S. Cl. ..... 62/6; 62/79

(58) Field of Classification Search ..... 62/6, 79, 62/114; 165/104.34, 117; 60/516, 526; 290/40 C, 290/40 E See application file for complete search history.

(56) References Cited

U.S. PATENT DOCUMENTS

| | | | |
|---|---|---|---|
| 3,548,589 A | 12/1970 | Cooke et al. | |
| 4,114,380 A | 9/1978 | Ceperley | |
| 4,355,517 A | 10/1982 | Ceperley | |
| 4,389,849 A | 6/1983 | Gasser et al. | |
| 4,398,398 A | 8/1983 | Wheatley et al. | |
| 4,489,553 A | 12/1984 | Wheatley et al. | |
| 4,534,176 A | 8/1985 | Horn et al. | |
| 4,686,407 A | 8/1987 | Ceperley | |
| 5,167,124 A | 12/1992 | Lucas | |
| 5,303,555 A | 4/1994 | Chrysler et al. | |
| 5,329,768 A | 7/1994 | Moscrip | |
| 5,357,757 A | 10/1994 | Lucas | |
| 5,369,625 A | 11/1994 | Gabrielson | |
| 5,647,216 A | 7/1997 | Garrett | |
| 5,673,561 A | 10/1997 | Moss | |
| 5,953,921 A * | 9/1999 | Garrett | 62/6 |
| 6,314,740 B1 | 11/2001 | De Blok et al. | |
| 6,385,972 B1 | 5/2002 | Fellows | |
| 6,560,970 B1 | 5/2003 | Swift | |
| 6,571,552 B2 | 6/2003 | Ban et al. | |

(Continued)

FOREIGN PATENT DOCUMENTS

EP 10171102 2/2011

(Continued)

OTHER PUBLICATIONS

Radebaugh, R., "Development of the Pulse Tube Refrigerator as an Efficient and Reliable Cryocooler", Proc. Inst. of Refrigeration (London 1999-2000).

(Continued)

*Primary Examiner* — Mohammad Ali
(74) *Attorney, Agent, or Firm* — Jonathan A. Small

(57) ABSTRACT

A thermo-electro-acoustic refrigerator comprises a sealed body having a regenerator, hot and cold heat exchangers, an acoustic source, and an acoustic energy converter. A first drive signal drives the acoustic source to produce an acoustic pressure wave in the region of the regenerator. The converter converts a portion of the acoustic pressure into a second drive signal which is fed back to and further drives the acoustic source. The pressure wave produces a thermal gradient between the cold and hot heat exchangers, permitting heat extraction (cooling) within at least one of the heat exchangers. The resonant frequency of the refrigerator can be controlled electronically, and is not limited by the physical structure of the refrigerator body and its elements.

12 Claims, 6 Drawing Sheets

U.S. PATENT DOCUMENTS

| | | | | |
|---|---|---|---|---|
| 6,574,968 | B1 | 6/2003 | Symko et al. | |
| 6,578,364 | B2 | 6/2003 | Corey | |
| 6,591,610 | B2 | 7/2003 | Yazawa et al. | |
| 6,604,364 | B1 | 8/2003 | Arman et al. | |
| 6,644,028 | B1 | 11/2003 | Swift et al. | |
| 6,658,862 | B2 | 12/2003 | Swift et al. | |
| 6,688,112 | B2 | 2/2004 | Raspet et al. | |
| 6,700,338 | B2 * | 3/2004 | Sugimoto et al. | 318/114 |
| 6,711,905 | B2 | 3/2004 | Howard | |
| 6,725,670 | B2 | 4/2004 | Smith et al. | |
| 6,732,515 | B1 | 5/2004 | Weiland et al. | |
| 6,792,764 | B2 | 9/2004 | Poese et al. | |
| 6,804,967 | B2 * | 10/2004 | Symko et al. | 62/6 |
| 6,868,673 | B2 | 3/2005 | Weiland et al. | |
| 6,910,332 | B2 | 6/2005 | Fellows | |
| 7,017,351 | B2 | 3/2006 | Hao et al. | |
| 7,055,332 | B2 | 6/2006 | Poese et al. | |
| 7,062,921 | B2 | 6/2006 | Jeng et al. | |
| 7,081,699 | B2 | 7/2006 | Keolian et al. | |
| 7,143,586 | B2 | 12/2006 | Smith et al. | |
| 7,156,487 | B2 | 1/2007 | Chou et al. | |
| 7,240,495 | B2 | 7/2007 | Symko et al. | |
| 7,263,837 | B2 | 9/2007 | Smith | |
| 7,290,771 | B2 * | 11/2007 | Smith | 277/634 |
| 7,434,409 | B2 | 10/2008 | Gedeon | |
| 2003/0159457 | A1 * | 8/2003 | Faqih | 62/285 |
| 2003/0188541 | A1 * | 10/2003 | Howard | 62/6 |
| 2003/0192322 | A1 * | 10/2003 | Garrett | 62/6 |
| 2003/0192323 | A1 * | 10/2003 | Poese et al. | 62/6 |
| 2003/0192324 | A1 | 10/2003 | Smith et al. | |
| 2003/0226364 | A1 * | 12/2003 | Swift et al. | 62/6 |
| 2005/0217279 | A1 * | 10/2005 | Mongia et al. | 62/6 |
| 2006/0266041 | A1 | 11/2006 | Fellows | |
| 2006/0266052 | A1 * | 11/2006 | Hsing et al. | 62/6 |
| 2006/0277925 | A1 * | 12/2006 | Matsubara et al. | 62/6 |
| 2007/0090723 | A1 * | 4/2007 | Keolian et al. | 310/311 |
| 2007/0261839 | A1 | 11/2007 | Watanabe et al. | |
| 2008/0060364 | A1 | 3/2008 | Watanabe et al. | |
| 2008/0156003 | A1 * | 7/2008 | Mongia | 62/79 |
| 2008/0203868 | A1 * | 8/2008 | Leclear et al. | 312/237 |

FOREIGN PATENT DOCUMENTS

| | | |
|---|---|---|
| EP | 10171103.4 | 2/2011 |
| GB | 1252258 | 11/1971 |
| WO | WO 2005/022606 A2 | 3/2005 |
| WO | 2008036920 A2 | 3/2008 |
| WO | 2009124132 A1 | 10/2009 |

OTHER PUBLICATIONS

Rossing, T. D. (Ed.), "Springer Handbook of Acoustics", Ch. 7, pp. 239-255 (Springer 2007).

Physorg.com, "A sound way to turn heat into electricity", 3 pages (Jun. 4, 2007).

Swift, G.W., et al., "Acoustic recovery of lost power in pulse tube refrigerators", J. Accoust. Soc. Am. (2), pt. 1, pp. 711-724 (Feb. 1999).

* cited by examiner

THERMO-ELECTRO-ACOUSTIC REFRIGERATOR AND METHOD OF USING SAME

CROSS-REFERENCE TO RELATED APPLICATIONS

The present disclosure is related to copending U.S. application for Letters Patent titled "Thermo-Electro-Acoustic Engine And Method Of Using Same", Ser. No. 12/533,839, filed on the same filing date and assigned to the same assignee as the present application, and further which, in its entirety, is hereby incorporated herein by reference.

BACKGROUND

The present disclosure is related to thermoacoustic devices, and more specifically to a thermoacoustic device employing an acoustic energy converter and electrical impedance network in place of selected portions of an acoustic impedance network.

The Stirling cycle is a well-known 4-part thermodynamic process, typically operating on a gas, to produce work, or conversely to effect heating or refrigeration. The 4 parts are: isothermal expansion, isochoric heat extraction, isothermal compression, and isochoric heat addition. The process is closed, in that the gas remains within the system at all times during the cycle.

One device that takes advantage of the Stirling cycle is the Stirling refrigerator. A typical Stirling refrigerator has one or more mechanical pistons, which control the heating/expansion and cooling/contraction of a contained gas as part of the Stirling cycle. Expansion of the gas as part of the Stirling cycle serves to cool a load. An element, typically called a regenerative heat exchanger or regenerator, increases the refrigerator's thermal efficiency. Devices of this type are often complex, involve seals, pistons, etc., and require regular maintenance.

Related types of refrigeration devices are thermoacoustic refrigerators. These devices share some fundamental physical properties with Stirling refrigerators, namely a contained gas which approximates a Stirling cycle. However, a thermoacoustic refrigerator differs from a Stirling refrigerator in that acoustic energy drives a temperature differential for extracting heat from the load. Unlike conventional Stirling refrigerators, the gas within a thermoacoustic refrigerator does not travel significantly within the body structure. Rather, the pressure wave propagates through the gas and the Stirling cycle takes place locally inside the regenerator.

Thermoacoustic refrigerators may operate with either substantially standing wave or traveling wave acoustic phasing in the regenerator. Standing-wave devices are known to be less efficient than traveling-wave devices.

FIG. 6 is a cross-sectional representation of one example 30 of known traveling-wave thermoacoustic refrigerator designs, known as an orifice pulse-tube refrigerator. As is typical, device 30 comprises a hollow, tubular, body structure 32 having a regenerator 34 located therein. Regenerator 34 is often simply a metal mesh or matrix. Regenerator 34 is proximate a first heat exchanger 36, generally a "hot" or "ambient" exchanger often at room temperature, at a first end thereof and a second heat exchanger 38, generally a "cold" exchanger, at the opposite end thereof. A third heat exchanger 39, generally at hot or ambient temperature, is typically present. An acoustic impedance network 40 is provided at one end of body structure 32. A motor and piston 42 is provided at the end of body structure 32 opposite acoustic impedance network 40. A pressurized gas is sealed within body structure 32. Acoustic energy in the form of a pressure wave generated by motor and piston 42 subjects the gas to periodic compression and expansion within regenerator 34. Under favorable conditions, the gas effectively undergoes an approximate Stirling cycle in the regenerator. This induces a temperature differential across the regenerator, i.e., between the hot and cold heat exchangers. Heat transfer may then be obtained between the gas and the heat exchangers, such that heat may be removed from the "cold" heat exchanger.

The acoustic impedance network 40 sets the relative phasing between the pressure and velocity waves so that the gas in contact with the regenerator approximates a Stirling cycle. This creates the thermal gradient between the "cold" and "hot" heat exchangers. However, in a pulse-tube refrigerator, no power is recovered in the gas expansion portion of the cycle. Therefore, the theoretical maximum efficiency of typical pulse-tube refrigerators is limited in comparison with that of Stirling refrigerators.

There are numerous other examples of Stirling and thermoacoustic refrigerators known in the art. U.S. Pat. No. 7,263,837 to Smith, U.S. Pat. No. 7,240,495 to Symko et al., and U.S. Pat. No. 6,804,967 also to Symko et al. illustrate several examples. Each of these U.S. patents is incorporated herein by reference. However, each of these examples presents its own set of disadvantages. One disadvantage of certain prior art devices is the dissipation of power in the acoustic impedance network, limiting their maximum theoretical efficiency. As the relative amount of power lost is greater with higher cold temperatures, this has inhibited the usefulness of thermoacoustic refrigerators for near-room-temperature applications. Another disadvantage of some prior art devices is the relatively large size of the acoustic impedance network. The size is a disadvantage for many applications, where a compact device is required.

SUMMARY

Accordingly, the present disclosure is directed to an efficient traveling wave thermoacoustic refrigerator. One characteristic of the refrigerator disclosed herein is that the device recovers the acoustic power at the cold heat exchanger. Another characteristic is the use of electromechanical elements and electrical circuitry to effect this recovery and the reuse of the recovered energy to improve the efficiency of the device.

The refrigerator consists of a body housing a regenerator, two heat exchangers with one on each side of the regenerator, two electroacoustic transducers with one on each end of the body opposite one another relative to the regenerator, and an external electrical network which serves to control the motion of the two transducers. Thus, useful thermal energy can be coupled to/from a load. The refrigerator may also contain a third heat exchanger separated from the cold heat exchanger by a length of the body.

According to one aspect of the disclosure, acoustic energy is introduced to the device by an electroacoustic transducer, referred to herein as the "acoustic source." A portion of this energy is used to thermoacoustically cool a load, as is described below. The acoustic energy that remains drives a second electroacoustic transducer, the "acoustic energy converter," and is converted to electrical energy. This energy is fed back through an electrical impedance network to help drive the acoustic source.

According to this aspect, an electrical impedance network replaces the acoustic impedance network and, in addition, effects power recovery. For this reason, the device disclosed herein is referred to as a thermo-electro-acoustic refrigerator. The electrical impedance network may take a variety of forms, and comprise a variety of passive and/or active elements.

The acoustic source drives a pressure wave within a closed body structure containing a gas. The closed body structure further contains a regenerator, and first and second heat exchangers, through which the pressure wave may travel. Located opposite the acoustic source relative to the regenerator is the acoustic energy converter, which converts the remaining pressure wave to an electrical signal. The third heat exchanger, if present, serves to control the temperature of the gas at a distance from the cold heat exchanger.

The electrical energy provided by the acoustic energy converter is output from the refrigerator and fed back to the acoustic source, subjected to an appropriate phase delay and impedance such that power transfer to the acoustic source is maximized. Furthermore, the electrical network, in combination with the electroacoustic transducers and acoustic elements, sets the impedance and phasing of the acoustic waves in the region of the regenerator.

Accordingly, a portion of the acoustic energy within the body is converted to electrical energy and fed back to the acoustic source to generate additional acoustic energy. At least a portion of this captured acoustic energy is energy that would otherwise be lost in a prior art acoustic impedance network.

The gas in the region of the regenerator is subjected to an approximate Stirling cycle, creating a thermal gradient in the regenerator. This thermal gradient results in heat addition to a "hot" heat exchanger adjacent the regenerator on a first side thereof, and extraction of heat from a "cold" heat exchanger adjacent the regenerator on a second side thereof opposite said first side.

The above is a summary of a number of the unique aspects, features, and advantages of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

Figure 1:
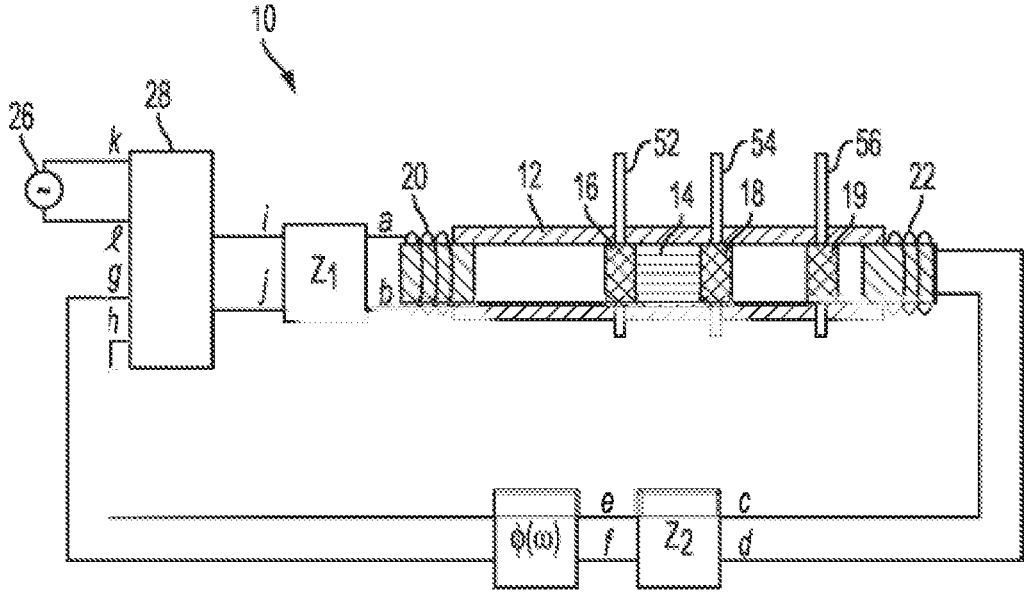
FIG. 1 is a schematic illustration of a first embodiment of a thermo-electro-acoustic refrigerator according to the present disclosure.

With reference to FIG. 1, there is shown therein a first embodiment 10 of a thermo-electro-acoustic refrigerator according to the present disclosure. Refrigerator 10 comprises a generally tubular body 12. The material from which body 12 is constructed may vary depending upon the application of the present invention. However, body 12 should generally be thermally and acoustically insulative, and capable of withstanding pressurization to at least several atmospheres. Exemplary materials for body 12 include stainless steel or an iron-nickel-chromium alloy.

Disposed within body 12 is regenerator 14. Regenerator 14 may be constructed of any of a wide variety of materials and structural arrangements which provide a relatively high thermal mass and high surface area of interaction with the gas but low acoustic attenuation. A wire mesh or screen, open-cell material, random fiber mesh or screen, or other material and arrangement as will be understood by one skilled in the art may be employed. The density of the material comprising regenerator 14 may be constant, or may vary along its longitudinal axis such that the area of interaction between the gas and wall, and the acoustic impedance, across the longitudinal dimension of regenerator 14 may be tailored for optimal efficiency. Details of regenerator design are otherwise known in the art and are therefore not further discussed herein.

Adjacent each lateral end of regenerator 14 are first and second heat exchangers 16, 18, respectively. Heat exchangers 16, 18 may be constructed of any of a wide variety of materials and structural arrangements which provide a relatively high efficiency of heat transfer from within body 12 to a transfer medium. In one embodiment, heat exchangers 16, 18 may be one or more tubes for carrying therein a fluid to be heated or cooled. The tubes are formed of a material and sized and positioned to efficiently transfer thermal energy (heating or cooling) between the fluid therein and the gas within body 12 during operation of the refrigerator. To enhance heat transfer, the surface area of the tubes may be increased with fins or other structures as is well known in the art. Tubes 52, 54 permit the transfer of fluid from a thermal reservoir or load external to refrigerator 10 to and from the first and second heat exchangers, respectively. Details of heat exchanger design are otherwise known in the art and are therefore not further discussed herein.

Optionally, a third heat exchanger 19 may be disposed within one end of body 12, for example such that heat exchanger 18 is located between third heat exchanger 19 and regenerator 14. Third heat exchanger 19 may be of a similar construction to first and second heat exchangers 16, 18 such as one or more tubes formed of a material and sized and positioned to efficiently transfer thermal energy (heating or cooling) between a fluid therein and the gas within body 12 during operation of the refrigerator. Tube 56 permits the transfer of fluid from a thermal reservoir or load external to refrigerator 10 to and from the third heat exchanger 19.

An acoustic source 20 is disposed at a first longitudinal end of body 12, and an acoustic converter 22 is disposed at a second longitudinal end of body 12 opposite to said acoustic source 20 relative to said regenerator 14. Many different types of devices may serve the function of acoustic source 20. A well-known moving coil, piezo-electric, electro-static, ribbon or other form of loudspeaker may form acoustic source 20. A very efficient, compact, low-moving-mass, frequency tunable, and frequency stable speaker design is preferred so that the cooling efficiency of the refrigerator may be maximized.

Likewise, many different types of devices may serve the function of acoustic converter 22. A well-known electrostatic, electromagnetic, piezo-electric or other form of microphone or pressure transducer may form acoustic converter 22. In addition, gas-spring, compliance elements, inertance elements, or other acoustic elements, may also be employed to enhance the function of converter 22. Again, efficiency is a preferred attribute of acoustic converter 22 so that the cooling efficiency of the refrigerator may be maximized.

Figure 2:
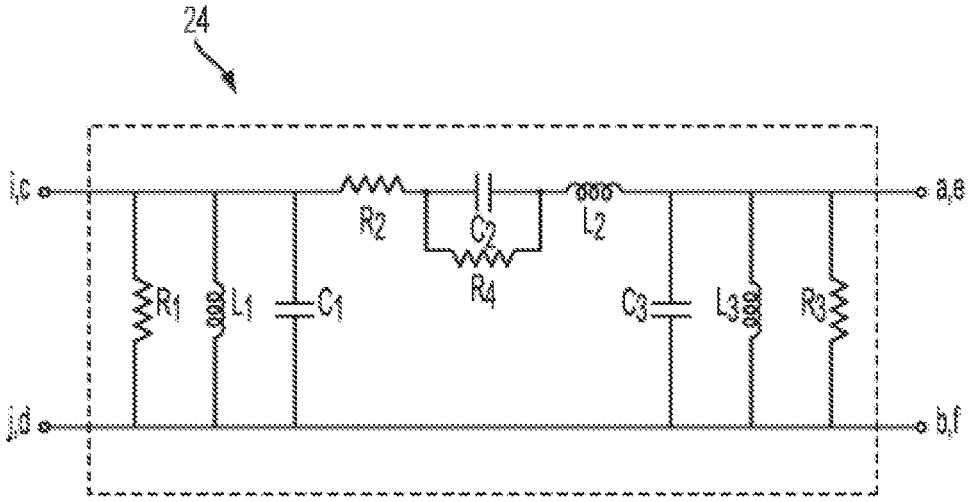
FIG. 2 is a schematic illustration of an impedance circuit for use in thermo-electro-acoustic refrigerator of FIG. 1.
Figure 4:
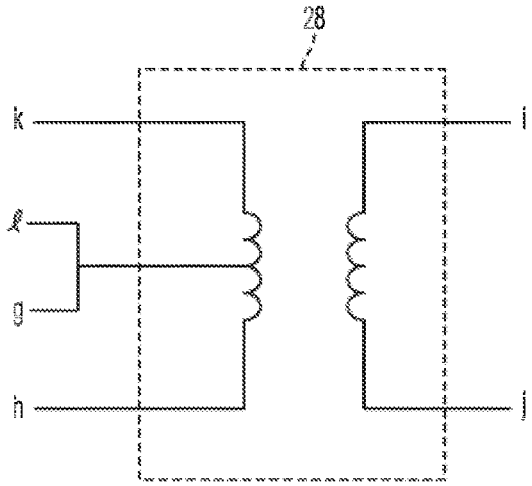
FIG. 4 is a schematic illustration of a power combiner for use in the thermo-electro-acoustic refrigerator of FIG. 1.

A driver 26 is connected to inputs k, l of a combiner 28 (of a type, for example, illustrate in FIG. 4). Driver 26 is an audio driver capable of driving acoustic source 20 at a desired frequency and amplitude, as discussed further herein. Outputs of combiner 28 form inputs to a impedance circuit $Z_1$, such as circuit 24, illustrated in FIG. 2. The outputs a, b of impedance circuit $Z_1$ form the inputs to acoustic source 20. Outputs e, f of a second impedance circuit $Z_2$, such as circuit 24, illustrated in FIG. 2 are connected as inputs g, h to combiner 28. Outputs c, d, from acoustic converter 22 are provided as inputs to the impedance circuit $Z_2$. The role of impedance circuits $Z_1$, $Z_2$, are to match the system impedances so as to drive acoustic source 20 efficiently at a desired frequency and phase. A phase delay circuit ($\phi(\omega)$) may also be employed to achieve the desired phasing as is well understood in the art.

Figure 3:
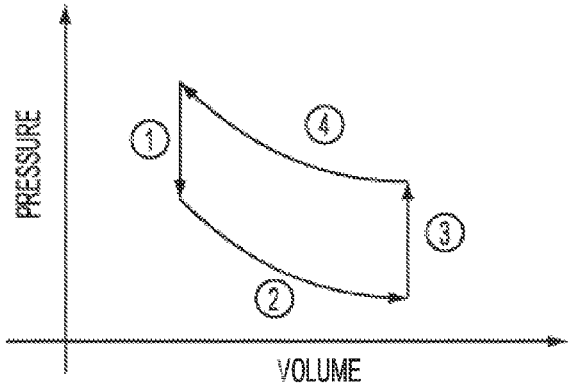
FIG. 3 is a graph of pressure versus volume illustrating the Stirling cycle as approximated by the gas in the thermo-electro-acoustic refrigerator of FIG. 1.

With the basic physical elements and their interconnections described above, we now turn to the operation of refrigerator 10. Initially, a gas, such as helium, is sealed within body 12. An acoustic wave is established within the gas by acoustic source 20. This acoustic wave causes the gas to undergo acoustic oscillations approximating a Stirling cycle. This cycle, illustrated in FIG. 3, comprises a constant-volume cooling of the gas as it moves in the direction from the hot heat exchanger to the cold heat exchanger at stage 1, isothermal expansion of the gas at stage 2, constant-volume heating of the gas as it moves in the direction from the cold heat exchanger to the hot heat exchanger at stage 3, and consequent isothermal contraction of the gas at stage 4, at which point the gas cools again and the process repeats itself. Remaining energy in the acoustic wave is converted into electrical energy by converter 22, and fed back as an additional input to acoustic source 20.

A temperature gradient is therefore established in regenerator 14. First heat exchanger 16 becomes a "hot" heat exchanger in that heat energy is extracted from the gas in the refrigerator 10 and rejected by the hot heat exchanger to the fluid therein. Likewise, second heat exchanger 18 becomes a "cold" heat exchanger in that heat energy is extracted from the fluid therein and transferred to the gas contained in refrigerator 10, and the fluid exits refrigerator 10 colder than it arrived. Cold fluid is thereby available at the output of that heat exchanger, which may be used for extracting heat external to refrigerator 10. Regenerator 14 serves to store heat energy and greatly improves the efficiency of this heat energy conversion process.

After the cooling process, a portion of the acoustic energy remains and is incident on converter 22, which converts a portion of that energy into electric energy. This electric energy is fed back to and helps drive acoustic source 20 via impedance circuits $Z_1$ and $Z_2$. With reference again to FIG. 2, the values of the electrical components (e.g., $R_{1-4}$, $L_{1-3}$, and $C_{1-3}$) are chosen such that in conjunction with the mechanical and acoustic components, positive feedback is established to maintain the oscillations at a desired phase, amplitude, and frequency and to maximize power transfer from the converter 22 to the source 20.

One benefit of the present disclosure is that the power recovery greatly improves the efficiency of the refrigerator. A further benefit is that electrical components can be more easily tuned than acoustic elements, increasing the simplicity and flexibility of optimization of the device.

Figure 5:
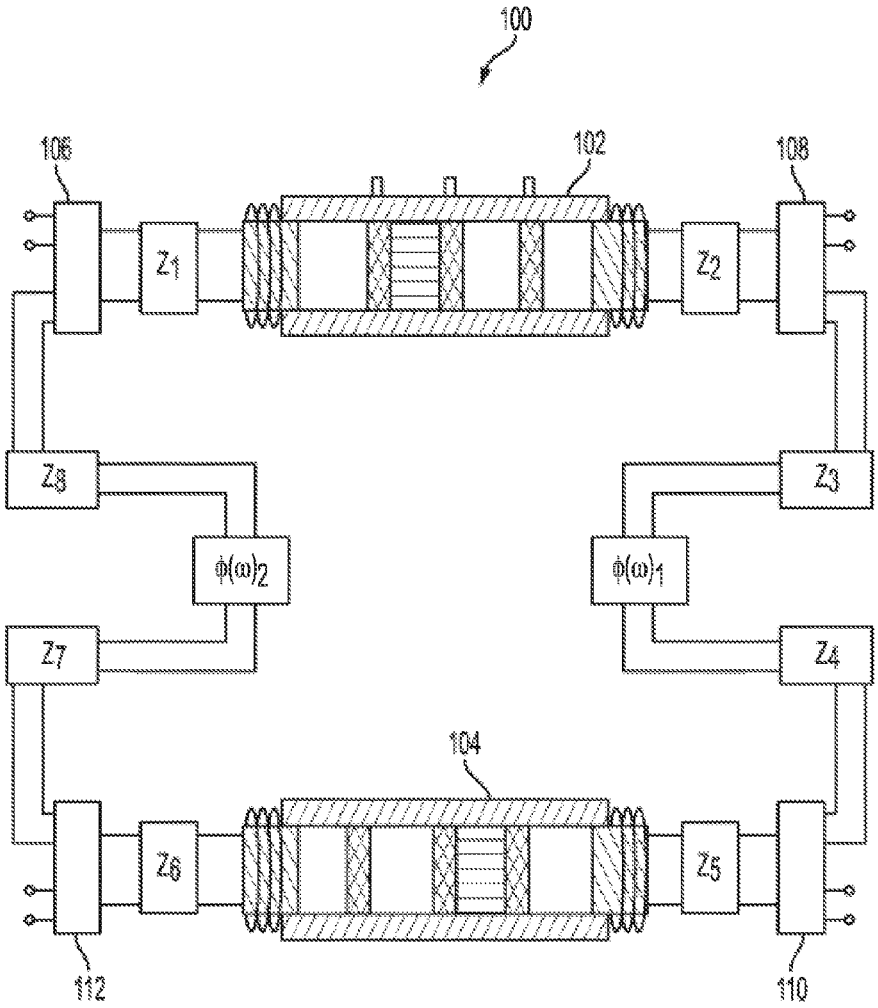
FIG. 5 is a schematic illustration of a series arrangement of a thermo-electro-acoustic engine and refrigerator according to one embodiment disclosed herein.
Figure 6:
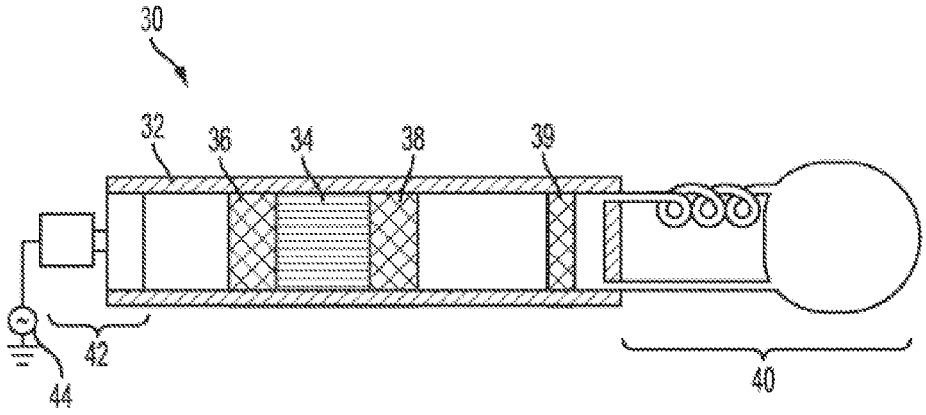
FIG. 6 PRIOR ART
FIG. 6 is an illustration of a thermoacoustic refrigerator of a type known in the art.

With reference now to FIG. 5, there is shown therein a system 100 comprised of a combined thermo-electro-acoustic engine portion 102 and thermo-electro-acoustic refrigerator portion 104 operating in series. A combiner 106 provides inputs to a first impedance circuit $Z_1$ that in turn provides electrical input to an acoustic source of engine portion 102. A second impedance circuit $Z_2$ receives the electrical output of a converter of engine portion 102, and provides same to splitter 108. Engine portion 102, combiner 106, impedance circuits $Z_1$ and $Z_2$, and splitter 108 may be, for example, substantially as described in the aforementioned copending U.S. patent application Ser. No. 12/533,839. A combiner 110 provides electrical input to an impedance circuit $Z_5$ which in turn provides electrical input to an acoustic source of refrigerator portion 104. An impedance circuit $Z_6$ receives the electrical output of a converter of refrigerator portion 104. An optional splitter 112 may receive the output of impedance circuit $Z_6$. Refrigerator portion 104, combiner 110, impedance circuits $Z_5$ and $Z_6$, and splitter 112 may be, for example, substantially as described herein above. Impedance circuits $Z_3$ and $Z_4$ as well as phase delay $\phi(\omega)_1$ condition the electrical output of splitter 108 such that it is input to combiner 110 with a desired frequency, amplitude, and phase. Likewise, impedance circuits $Z_7$ and $Z_8$ as well as phase delay $\phi(\omega)_2$ condition the electrical output of splitter 112 (or optionally the output directly from the converter of refrigerator portion 104) such that it is input to combiner 106 with a desired frequency, amplitude, and phase. Impedance circuits $Z_3$, $Z_4$, $Z_7$, and $Z_8$ may be such as illustrated in FIG. 2, circuit 24.

In operation, system 100 uses a thermal gradient established within the regenerator of engine portion 102 to create an acoustic wave within engine portion 102. A portion of that wave is converted into electrical energy by the converter of engine portion 102, as described in more detail in the aforementioned U.S. patent application Ser. No. 12/533,839. At least a portion of that electrical energy is provide by splitter 108 to impedance circuits $Z_3$ and $Z_4$ as well as phase delay $\phi(\omega)_1$ and ultimately forms the input driving energy for the acoustic source of refrigerator portion 104. Refrigerator portion 104 is operated as described above such that heat is extracted from the fluid within the "cold" heat exchanger. A cold fluid is thereby available at the output of that heat exchanger, which may be used for extracting heat external to refrigerator portion 104. Excess electrical energy is converted by the converter of refrigerator 104, and provided via an impedance circuit $Z_6$, splitter 112, impedance circuits $Z_7$ and $Z_8$, and phase delay $\phi(\omega)_2$ to the input of combiner 106, and ultimately provides input energy to the acoustic source of engine portion 102 to amplify the acoustic wave therein, as described in the aforementioned U.S. patent application Ser. No. 12/533,839. In addition, electrical energy can be provided to system 100, for example to drive engine portion 102 and/or refrigerator portion 104, from a source external to system 100, by applying same at combiners 106, 110 respectively, as described herein and in the aforementioned U.S. patent application Ser. No. 12/533,839. Furthermore, electrical energy can be extracted from system 100, for example to do work external to system 100, by tapping same at splitters 108, 112 respectively, as described herein and in the aforementioned U.S. patent application Ser. No. 12/533,839.

As an alternative to system 100, the output of a thermo-electro-acoustic refrigerator, for example system 10 as described above, may receive as its inputs k, l, the output from a post-converter splitter of a thermo-electro-acoustic engine of the type described and disclosed in the aforementioned U.S. patent application Ser. No. 12/533,839. In one embodiment of this alternative, the thermo-electro-acoustic refrigerator receives no other electrical input.

Figure 7:
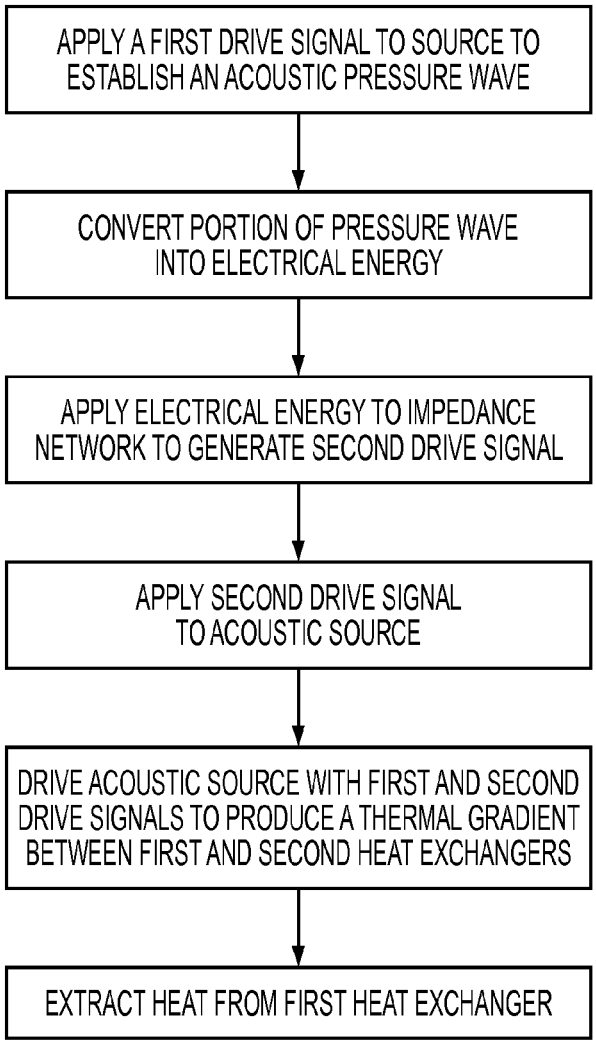
FIG. 7 is a flow chart illustrating method of operating a thermo-electro-acoustic refrigerator according to an embodiment of the present disclosure.

With reference to FIG. 7, a method of operating a thermo-electro-acoustic refrigerator pursuant to the above description of an embodiment of the present disclosure is shown.

No limitation in the description of the present disclosure or its claims can or should be read as absolute. The limitations of the claims are intended to define the boundaries of the present disclosure, up to and including those limitations. To further highlight this, the term "generally" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "nearly", "within technical limitations", and the like.

Furthermore, while a plurality of preferred exemplary embodiments have been presented in the foregoing detailed description, it should be understood that a vast number of variations exist, and these preferred exemplary embodiments are merely representative examples, and are not intended to limit the scope, applicability or configuration of the disclosure in any way. For example, the above description is in terms of a tubular structure with coaxially arranged elements. However, other physical arrangements may be advantageous for one application or another, such as a curved or folded body, locating either or both source and converter non-coaxially (e.g., on a side as opposed to end of the body), etc., and are contemplated by the present description and claims, Thus, various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described embodiments may be made without departing from the spirit and scope of the disclosure defined by the claims thereto.

What is claimed is:

1. A thermo-electro-acoustic refrigerator, comprising:

a generally hollow body having first and second open ends, said body containing a working gas;

a regenerator disposed within said body;

a first heat exchanger disposed within said body and proximate said regenerator at a first longitudinal end thereof;

a second heat exchanger disposed within said body and proximate said regenerator at a second longitudinal end thereof;

an acoustic source coupled to said first end of said body such that acoustic energy from said acoustic source is directed into said body;

a driver communicatively connected to said acoustic source for providing a first driving signal to said acoustic source;

an acoustic energy converter coupled to said second end of said body opposite said first end relative to said regenerator such that at least a portion of the acoustic energy within said body is converted by said converter into electrical energy; and said converter electrically coupled to said acoustic source such that at least a portion of electrical energy produced by said converter is provided to and drives said acoustic source as a second driving signal;

whereby said acoustic energy operates on the gas in the region of the regenerator to produce a thermal gradient which adds heat to said first heat exchanger and extracts heat from said second heat exchanger.

2. The thermo-electro-acoustic refrigerator of claim 1, further comprising impedance matching circuitry disposed between and in electrical communication with said converter and said acoustic source such that electrical energy provided by said converter is coupled to said acoustic source such that the transfer of energy from the converter to the source can be maximized.

3. The thermo-electro-acoustic refrigerator of claim 2, further comprising a phase delay device disposed between and in electrical communication with either said converter and said impedance matching circuitry or said impedance matching circuitry and said acoustic source such that the phase of the electrical energy can be controlled to provide a controlled phase relationship between the first and second driving signals.

4. The thermo-electro-acoustic refrigerator of claim 1, wherein said converter and source are electromagnetic transducers.

5. The thermo-electro-acoustic refrigerator of claim 1, wherein said converter and source are piezoelectric transducers.

6. The thermo-electro-acoustic refrigerator of claim 1, further comprising a third heat exchanger disposed within said body and between said second heat exchanger and said acoustic energy converter.

7. A method of operating a thermo-electro-acoustic refrigerator comprising:

applying a first drive signal to an acoustic source acoustically coupled to a body, said body having disposed therein a regenerator, first and second heat exchangers on opposite sides of said regenerator, and a pressurized gas, said acoustic source thereby establishing an acoustic pressure wave in the region of said regenerator;

converting, using an acoustic converter, a portion of said pressure wave into electrical energy;

selecting an appropriate electrical impedance network such that said portion of said acoustic energy converted into electrical energy can be optimally used as a second drive signal to the acoustic source;

providing the second drive signal to the acoustic source for use thereby in the generation of an acoustic signal of a desired frequency; and driving the acoustic source with said first and second drive signals such that said acoustic pressure wave produced thereby establishes a thermal gradient between said first and second heat exchangers;

whereby, the thermal gradient results in an extraction of heat from said first heat exchanger.

8. The method of claim 7, further comprising controllably adjusting the phase of the electrical energy obtained from the conversion of the portion of the pressure wave such that the phase of the second drive signal matches the phase of the first drive signal.

9. A system which utilizes a thermo-electro-acoustic engine to provide electrical input to a thermo-electro-acoustic refrigerator, comprising:

a thermo-electro-acoustic engine portion, comprising:

a generally hollow body having first and second open ends, said body containing a working gas;

a regenerator disposed within said body;

a first heat exchanger disposed within said body and proximate said regenerator at a first longitudinal end thereof;

a second heat exchanger disposed within said body and proximate said regenerator at a second longitudinal end thereof;

an acoustic source coupled to said first end of said body such that acoustic energy from said acoustic source is directed into said body;

an acoustic energy converter coupled to said second end of said body opposite said first end relative to said regenerator such that a portion of said acoustic energy within said body is directed to said converter and converted thereby into electrical energy;

a thermo-electro-acoustic refrigerator portion, comprising:

a generally hollow body having first and second open ends, said body containing a working gas;

a regenerator disposed within said body;

a first heat exchanger disposed within said body and proximate said regenerator at a first longitudinal end thereof;

a second heat exchanger disposed within said body and proximate said regenerator at a second longitudinal end thereof;

an acoustic source coupled to said first end of said body such that acoustic energy from said acoustic source is directed into said body;

an acoustic energy converter coupled to said second end of said body opposite said first end relative to said regenerator such that at least a portion of the acoustic energy within said body is converted by said converter into electrical energy;

said thermo-electro-acoustic engine portion and said thermo-electro-acoustic refrigerator portion communicatively coupled such that at least a portion of said electrical energy produced by said converter of said thermo-electro-acoustic engine portion is provided as an input to and drives said acoustic source of said thermo-electro-acoustic refrigerator portion.

10. The system of claim 9, further arranged such that at least a portion of said electrical energy produced by said converter of said thermo-electro-acoustic refrigerator portion is provided as an input to and drives said acoustic source of said thermo-electro-acoustic engine portion.

11. The system of claim 9, further comprising:

a first impedance and phase delay circuit electrically coupled to said converter of said thermo-electro-acoustic engine portion such that at least a portion of electrical energy produced by said converter of said thermo-electro-acoustic engine portion is conditioned to have a desired frequency and phase; and a splitter electrically coupled to said first impedance circuit, said splitter comprising first output terminals such that a portion of electrical energy produced by said converter of said thermo-electro-acoustic engine portion may be provided to said first output terminals for utilization external to said system, said splitter further comprising second output terminals such that a portion of electrical energy produced by said converter of said thermo-electro-acoustic engine portion may be provided to second output terminals; and said second output terminals electrically connected to said acoustic source of said thermo-electro-acoustic refrigerator portion such that electrical energy provided by said second output terminals may be input to and drive said acoustic source of said thermo-electro-acoustic refrigerator portion.

12. The system of claim 11, further comprising a second impedance and phase delay circuit, disposed between and in electrical communication with output terminals of said converter of said thermo-electro-acoustic refrigerator portion and input terminals of said acoustic source of said thermo-electro-acoustic engine portion, such that said electrical energy provided by said converter of said thermo-electro-acoustic refrigerator portion may be conditioned to have a desired at least one of frequency and phase, and thereafter be input to and drive the acoustic source of said thermo-electro-acoustic engine portion.

* * * * *